US006526987B1

(12) United States Patent
Gioia

(10) Patent No.: US 6,526,987 B1
(45) Date of Patent: Mar. 4, 2003

(54) SELF-APPLICATOR FOR HAIR COLORING

(76) Inventor: Sun R. Gioia, 14401 Woodmere Ct., Centerville, VA (US) 20120

( * ) Notice: Subject to any disclaimer, the term of this patent is extended or adjusted under 35 U.S.C. 154(b) by 0 days.

(21) Appl. No.: 09/985,253

(22) Filed: Nov. 2, 2001

(51) Int. Cl.[7] ..... A45D 24/22
(52) U.S. Cl. ..... 132/114; 132/112; 132/111
(58) Field of Search ..... 132/114, 113, 132/111, 116, 115, 219, 159, 148

(56) References Cited

U.S. PATENT DOCUMENTS

| | | | | | |
|---|---|---|---|---|---|
| 1,431,943 | A | * | 10/1922 | Gee | 132/114 |
| 1,829,021 | A | * | 10/1931 | Sinclair | 132/114 |
| 2,381,048 | A | * | 8/1945 | Habostad | 132/114 |
| 3,101,086 | A | * | 8/1963 | Di Vito | 132/114 |
| 4,495,958 | A | * | 1/1985 | Roeder | 132/113 |
| 5,311,887 | A | * | 5/1994 | Ramsey | 132/114 |
| 6,260,557 | B1 | * | 7/2001 | Yarbrough | 132/208 |
| 6,334,449 | B1 | * | 1/2002 | Burrowes et al. | 132/114 |

* cited by examiner

*Primary Examiner*—John J. Wilson
*Assistant Examiner*—Robyn Kieu Doan
(74) *Attorney, Agent, or Firm*—Burns, Doane, Swecker & Mathis, LLP

(57) ABSTRACT

A self applicator for hair coloring includes an applicator body having an attachment portion adapted to be attached to a squeeze container, and a plurality of prongs projecting forwardly with respect to the attachment portion. Each prong includes a channel extending therethrough to a discharge end of the prong. The discharge end includes an outlet opening for dispensing the coloring. Each outlet opening is surrounded by a rub-in surface of at least 1.0 mm in width configured to bear against the user's scalp for rubbing in the dispensed coloring into the roots of the hair follicles. Each rub-in surface extends at an oblique angle with respect to a longitudinal axis of a respective channel. A reservoir is disposed between each channel and a respective outlet opening, the reservoir being of larger cross section than a junction between the reservoir and the channel. An accumulation space is formed between the attachment portion and the prongs for accumulating coloring being delivered to the prongs.

17 Claims, 3 Drawing Sheets

SELF-APPLICATOR FOR HAIR COLORING

BACKGROUND OF THE INVENTION

The present invention pertains to a hair color applicator for enabling users to apply hair color to their own hair, i.e., the applicator is a self-applicator for use with home hair coloring kits.

Home hair coloring kits typically comprise a container of hair dye, a liquid mixer with which the hair dye is to be mixed, and an applicator bottle in which the mixing is performed and from which the mixture is to be dispensed.

The bottle is a squeeze type bottle topped with a standard applicator that is screwed onto the bottle. The applicator includes a slim conical neck that tapers toward an open, discharge end of the neck.

In order to apply the coloring to the base of the hair follicles, the bottle is inverted such that the discharge end of the neck is directed downwardly toward the user's scalp. The user then squeezes the bottle while moving the neck along the scalp in a direction extending between the front and back of the head, in order to deposit a row of coloring onto the scalp. This is done numerous times, in order to deposit the coloring in numerous parallel rows to cover the entire scalp. Since the user cannot easily see the rows that are being made, it is difficult for the user to apply the coloring in parallel, equally spaced rows as is necessary to achieve a uniform distribution of coloring.

An effort has been made to deal with that problem by providing an applicator with a plurality of parallel, spaced apart thin prongs or necks which are forwardly tapered, as shown in FIG. 7. The applicator 10 shown therein has a comb-like appearance produced by the prongs 12. Through the use of such an applicator 10, it is possible to apply numerous parallel, evenly spaced rows of coloring with each stroke, or pass, of the applicator. However, in order to properly distribute each applied row of coloring to the hair bases, it is then necessary for the user to rub the coloring with the finger tips. This is relatively easy for a professional hair care specialist to perform while standing over a customer and looking downwardly toward the customer's scalp, but is very difficult for persons to perform on themselves when self-applying the coloring with a comb-like applicator, due to the difficulty in seeing where the rows of coloring have been applied. Consequently, the coloring of each row may not be evenly distributed.

In addition, the discharge opening of each prong of the comb-like applicator are aligned with the axis of the respective prong, so it is necessary to hold the applicator bottle at a steep angle (i.e., nearly vertical) when applying the coloring, which can eventually become uncomfortable and tiring to the user's hand.

Therefore, it would be desirable to provide a self-applicator for hair coloring which facilitates the distribution of the coloring to the bases of the hair follicles, and which is more comfortable to use.

SUMMARY OF THE INVENTION

A self-applicator for hair coloring comprises an applicator body having an attachment portion adapted to be attached to a squeeze container, and at least prong projecting forwardly with respect to the attachment portion. The prong includes a channel extending therethrough to a discharge end of the prong. The discharge end of the prong includes an outlet opening for dispensing the coloring. The outlet opening is surrounded by a rub-in surface configured to bear against the user's scalp for rubbing-in the dispensed coloring into the roots of the hair follicles.

Preferably, the rub-in surface is oriented at an oblique angle relative to an axis of the respective channel.

Preferably, a cross section above prong tapers downwardly toward a lower edge of the prong.

The rub-in surface has a width of at least 1.0 mm, and more preferably at least 2.0 mm.

A reservoir is preferably disposed between the channel and a respective outlet opening. The reservoir is of larger cross section than a junction between the reservoir and the channel.

Preferably, there is a plurality of the prongs which extend generally parallel to one another. In that case there is preferably formed an accumulation space between the attachment portion and the prongs for accumulating coloring being delivered to the prongs.

BRIEF DESCRIPTION OF THE DRAWINGS

The objects and advantages of the invention will become apparent from the following detailed description of a preferred embodiment thereof in connection with the accompanying drawings in which like numerals designate like elements and in which.

DETAILED DESCRIPTION OF PREFERRED EMBODIMENTS OF THE INVENTION

Figure 1:
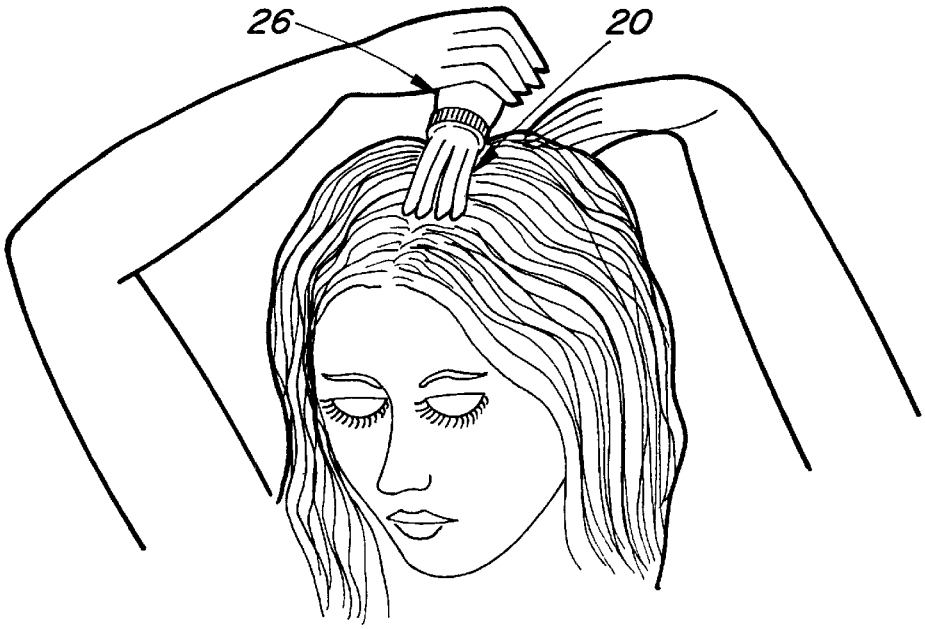
FIG. 1 depicts a person using an applicator according to the present invention to apply hair coloring.
Figure 2:
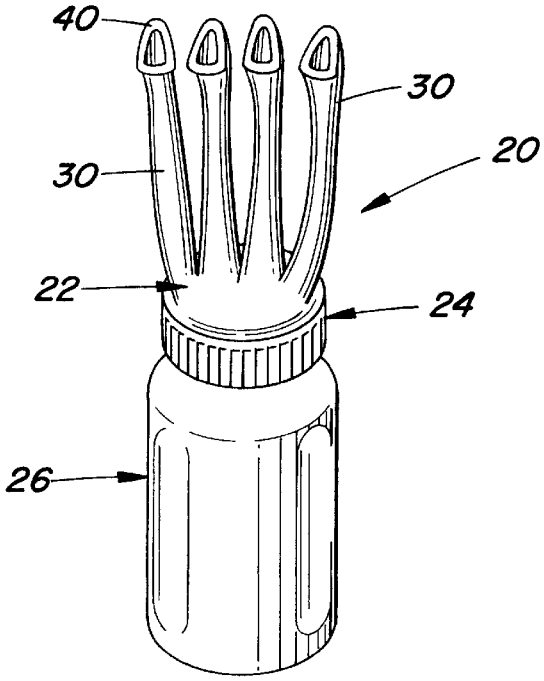
FIG. 2 is a perspective view of an applicator according to the invention attached to a squeeze bottle.
Figure 3:
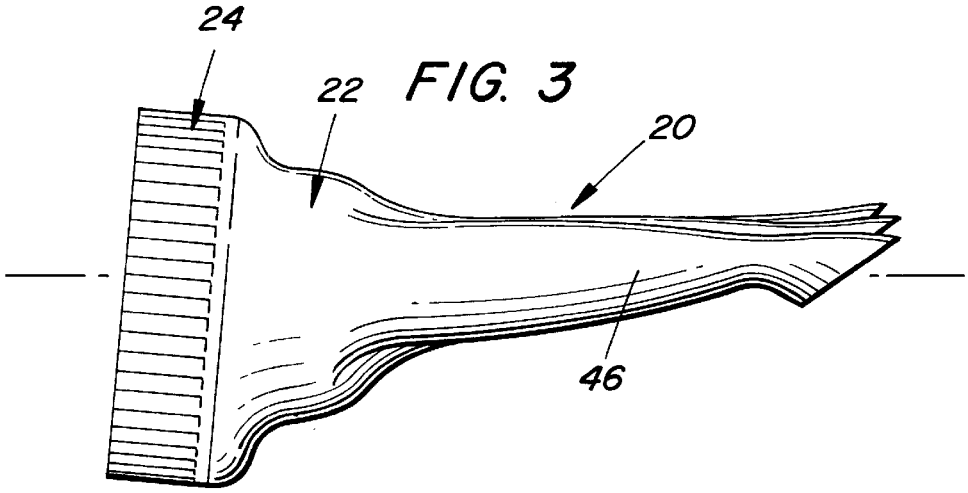
FIG. 3 is a side elevational view of the applicator.

Depicted in FIGS. 1–6 is a hair coloring applicator 20 comprised of a body 22 formed of a suitable plastic material. The body 22 includes a rear attachment portion 24 adapted to be connected to a squeeze type bottle 26. The attachment portion includes a female screw thread 27 for being attached to a male screw thread 27*a* formed around a rim of the bottle.

The body 22 is hollow and thus forms an interior space which includes an accumulator portion 28 situated between the attachment portion 24 and a plurality of parallel prongs 30 of the body. Each prong is hollow and forms a channel 32 which has a rear end in communication with the accumulator portion 28 and a front end which communicates with a reservoir 34 that leads to an outlet opening 36 of the prong. Each channel 32 becomes of progressively smaller cross section toward its front end and then expands into a larger reservoir 34.

The outlet opening 36 extends an oblique angle a with respect to a longitudinal axis 38 of the respective channel and is surrounded by a rub-in surface 40 which is oriented at an oblique angle β with respect to the axis 38 of the respective channel. The angle β is directed such that a lower end 42 of each rub-in surface 40 is located closer to the accumulation portion than is an upper end 44 of each rub-in surface (see FIG. 4).

Each rub-in surface 40 extends around the entire opening 36, is generally flat (although possibly slightly curved) and has a width W of at least 1.0 mm, preferably at least 2.0 mm.

Figure 4A:
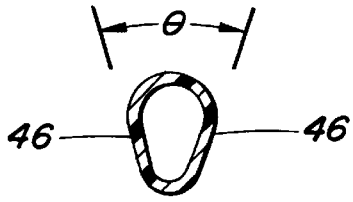
FIG. 4A is a cross sectional view taken along the line 4A—4A in FIG. 4.
Figure 4:
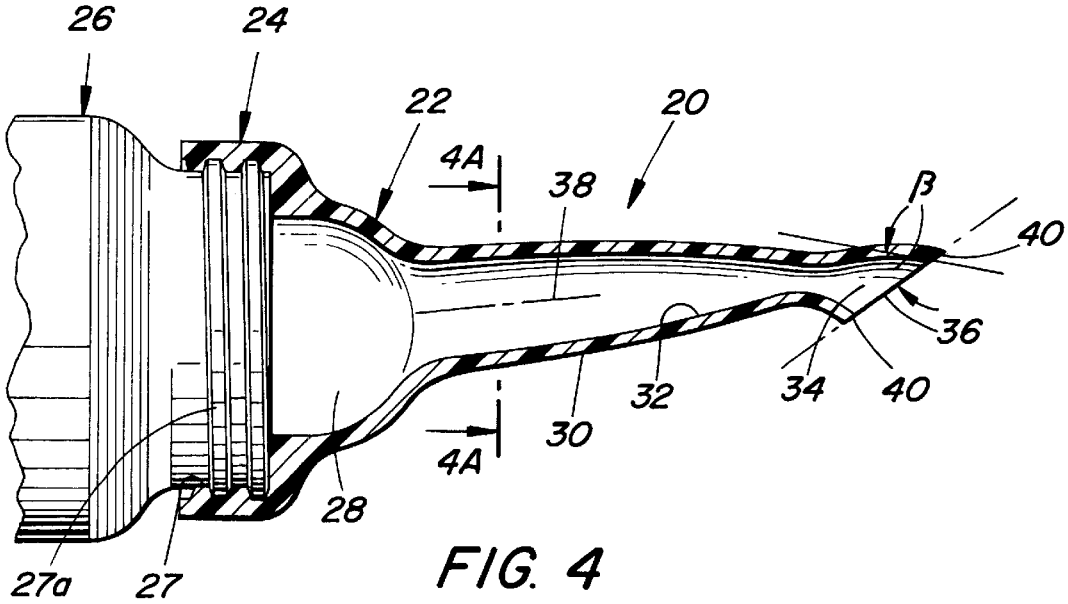
FIG. 4 is a longitudinal sectional view taken through the applicator which is attached to the squeeze bottle.
Figure 5:
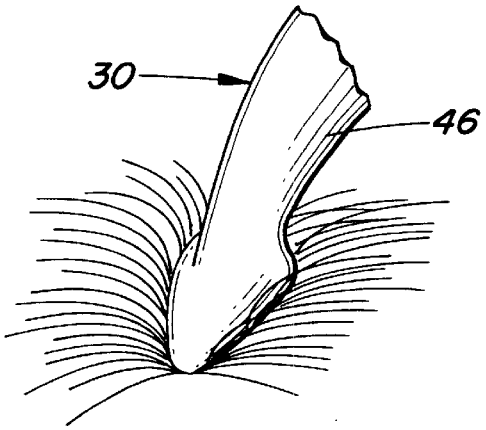
FIG. 5 is a fragmentary view of a front-end of an applicator prong as it travels along the scalp.
Figure 6:
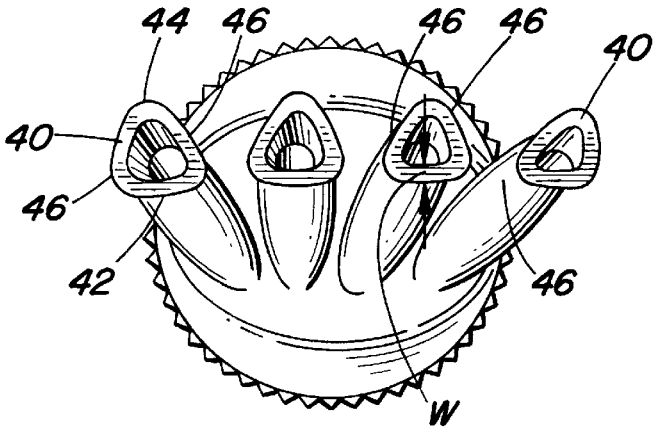
FIG. 6 is a front view of the applicator.
Figure 7:
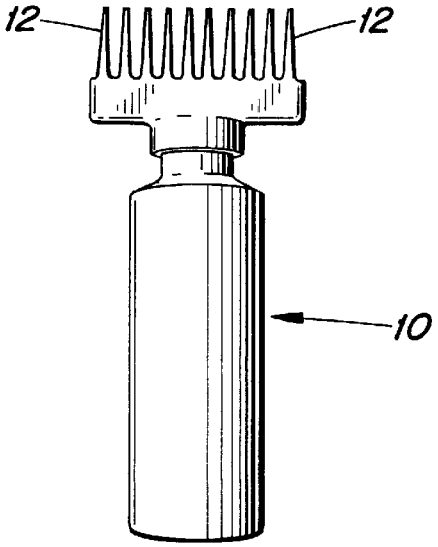
FIG. 7 (PRIOR ART)
FIG. 7 is a side elevational view of a prior art hair color applicator.

Each prong 30 has side surfaces 46 which diverge upwardly toward an upper edge of the prong at any suitable angle θ, as shown in FIG. 4A, to aid in separating hair follicles during use of the applicator.

In use, the bottle 26 is held above the user's head (FIG. 1), with the rub-in surfaces 40 bearing against the user's scalp. Since the rub-in surfaces 40 are oriented at the angle β relative to the channel axes, the bottle need not be held at a severe (i.e., almost vertical) angle, but rather can be held at a less severe angle (i.e., closer to a horizontal position) which is more comfortable for the user.

When the bottle is squeezed, coloring is forced into the accumulation portion 28 and through the channels 32. The presence of the accumulation portion 28, which is in communication with all channels 32, ensures a uniform distribution of coloring to the respective channels. After traveling through the channels 32, the coloring enters the reservoirs 34 and then exits the prongs via the outlet opening 36. This occurs as the applicator is being moved along the user's scalp, whereby parallel rows of coloring are being dispensed. During this movement of the applicator, the applicator can also be moved in a slight circular motion, whereby the rub-in surfaces 40 rub the coloring into the hair bases disposed along the respective rows. That is, the prongs 30 simulate the motion that would be performed if the user were rubbing-in the coloring with his/her fingers.

Advantageously, the reservoirs 34 serve to ensure that an adequate supply of coloring is available to the outlet openings 36 during the circular movement of the prongs, whereby the coloring can be continuously and uniformly applied.

The upwardly diverging sides 46 of each prong help to spread apart the hair follicles apart on each side of the row being formed.

It will be understood that although the preferred applicator which is depicted has four prongs 30, that number is not critical. More or fewer prongs, or even just one prong, could be employed instead.

It will be appreciated that the invention greatly simplifies the self-application of hair coloring and makes it easier to achieve a uniform distribution of coloring to the follicle roots without requiring that the user rub-in the coloring with his/her fingers. The operation is less messy and less tiring for the user.

Although the present invention has been described in connection with preferred embodiments thereof, it will be appreciated by those skilled in the art that additions, deletions, modifications, and substitutions not specifically described may be made without departing from the spirit and scope of the invention as defined in the appended claims.

What is claimed is:

1. A self-applicator for hair coloring, comprising an applicator body having an attachment portion adapted to be attached to a squeeze container, and at least one prong projecting forwardly with respect to the attachment portion, the prong including a channel extending therethrough to a discharge end of the prong, the discharge end of the prong including an outlet opening for dispensing the coloring, the outlet opening surrounded by a rub-in surface configured to bear against the user's scalp for rubbing-in the dispensed coloring onto the roots of the hair follicles, the channel extending to a location adjacent the outlet opening and merging into a reservoir disposed within the prong between the channel and the outlet opening, the reservoir and the outlet opening being of larger cross section than a junction between the channel and the reservoir.

2. The self-applicator according to claim 1 wherein the rub-in surface is oriented at an oblique angle relative to an axis of the respective channel.

3. The self-applicator according to claim 2 wherein the rub-in surface defines a lower end and an upper end, the lower end being disposed closer to the attachment portion than is the upper portion, the prong including upper and lower portions interconnected by side surfaces, the side surfaces diverging upwardly.

4. The self-applicator according to claim 2 wherein the outlet opening is oriented at an oblique angle relative to an axis of the respective channel.

5. The applicator according to claim 1 wherein each rub-in surface has a width of at least 1.0 mm.

6. The applicator according to claim 5 wherein the width is at least 2.0 mm.

7. The self-applicator according to claim 1 wherein each outlet opening is oriented at an oblique angle relative to an axis of the respective channel.

8. The self-applicator according to claim 1 wherein each rub-in surface defines a lower end and an upper end, the lower end being disposed closer to the attachment portion than is the upper portion, each prong including upper and lower portions interconnected by side surfaces, the side surfaces diverging upwardly.

9. The self-applicator according to claim 1 wherein the at least one prong comprises a plurality of the prongs, the body forming an accumulation space formed between the attachment portion and the prongs for accumulating coloring being delivered to the prongs.

10. The self-applicator according to claim 1 wherein the rub-in surface defines a lower end and an upper end, the lower end being disposed closer to the attachment portion than the upper portion, the prong including upper and lower portions interconnected by side surfaces, the side surfaces diverging upwardly.

11. A self-applicator for hair coloring comprising an applicator body having an attachment portion adapted to be attached to a squeeze container, and a plurality of prongs projecting forwardly with respect to the attachment portion, each prong including a channel extending therethrough to a discharge end of the prong, the discharge end of each prong including an outlet opening for dispensing the coloring, each outlet opening surrounded by a forwardly facing rub-in surface configured to bear against the user's scalp for rubbing-in the dispensed coloring onto the roots of the hair follicles, each rub-in surface oriented at an oblique angle relative to an axis of the respective channel, each channel extending to a location adjacent the outlet opening and merging into a reservoir disposed within the prong between each channel and a respective outlet opening, each reservoir and the associated outlet opening being of larger cross section than a junction between a respective reservoir and the channel.

12. The self-applicator according to claim 11 wherein each rub-in surface defines a lower end and an upper end, the lower end disposed closer to the attachment portion than the upper portion, each prong including upper and lower edges, a cross section of each prong tapering toward the lower edge.

13. The self-applicator according to claim 11 wherein each outlet opening is oriented at an obtuse angle relative to an axis of the respective channel.

14. The self-applicator according to claim 11 wherein each rub-in surface has a width of at least 1.0 mm.

15. A self-applicator for hair coloring comprising an applicator body having an attachment portion adapted to be attached to a squeeze container, and a plurality of prongs projecting forwardly with respect to the attachment portion, each prong including a channel extending therethrough to a discharge end of the prong, the discharge end of each prong including an outlet opening for dispensing the coloring, each outlet opening surrounded by a forwardly facing rub-in surface configured to bear against the user's scalp for rubbing-in the dispensed coloring onto the roots of the hair follicles, each channel extending to a location adjacent the outlet opening and merging into a reservoir disposed within the prong between each channel and a respective outlet opening, the reservoir and the associated outlet opening being of larger cross section than a junction between the reservoir and the channel, an accumulation space formed between the attachment portion and the prongs for accumulating coloring being delivered to the prongs.

16. The self-applicator according to claim 15 wherein each rub-in surface has a width of at least 1.0 mm.

17. A self-applicator for hair coloring comprising an applicator body having an attachment portion adapted to be attached to a squeeze container, and a plurality of prongs projecting forwardly with respect to the attachment portion, each prong including a channel extending therethrough to a discharge end of the prong, the discharge end of each prong including an outlet opening for dispensing the coloring, each outlet opening surrounded by a forwardly facing rub-in surface configured to bear against the user's scalp for rubbing-in the dispensed coloring onto the roots of the hair follicles, each rub-in surface oriented at an oblique angle relative to an axis of the respective channel, each rub-in surface having a width of at least 1.0 mm; each channel extending to a location adjacent the outlet opening and merging into a reservoir disposed within the prong between the channel and a respective outlet opening, the reservoir and the associated outlet opening being of larger cross section than a junction between the reservoir and the channel, the body forming an accumulation space between the attachment portion and the prongs for accumulating coloring being delivered to the prongs, each prong having upper and lower portions interconnected by side surfaces which diverge upwardly.

* * * * *